US005163564A

United States Patent [19]

Matula

[11] Patent Number: 5,163,564

[45] Date of Patent: Nov. 17, 1992

[54] DISC SCREEN WITH CONTROLLED INTERFACIAL OPENINGS

[75] Inventor: Conrad Matula, Memphis, Tenn.

[73] Assignee: Beloit Technologies, Inc., Wilmington, Del.

[21] Appl. No.: 671,067

[22] Filed: Mar. 18, 1991

[51] Int. Cl.[5] ..... B07B 1/16

[52] U.S. Cl. ..... 209/672; 209/667

[58] Field of Search ..... 209/667, 668, 671, 672, 209/274, 279, 361

[56] References Cited

U.S. PATENT DOCUMENTS

| | | | |
|---|---|---|---|
| 893,905 | 7/1908 | Dodge | 209/361 |
| 1,399,211 | 12/1921 | Hollingbery | 209/672 |
| 1,524,360 | 1/1925 | Lauritzen | 209/671 |
| 1,621,695 | 3/1927 | Tuite et al. | 209/668 |
| 1,899,737 | 2/1933 | Ulrich | 209/672 |
| 2,150,717 | 3/1939 | Jaxon | 209/672 X |
| 2,699,253 | 1/1955 | Miller | 209/672 |
| 4,741,444 | 5/1988 | Bielagus | 209/672 |
| 4,901,863 | 2/1990 | Lancaster | 209/672 X |
| 4,901,864 | 2/1990 | Daugherty | 209/672 |
| 4,972,959 | 11/1990 | Bielagus | 209/667 X |
| 4,972,960 | 11/1990 | Bielagus | 209/672 |

FOREIGN PATENT DOCUMENTS

| | | | |
|---|---|---|---|
| 0173638 | 3/1986 | European Pat. Off. | 209/672 |
| 0053386 | 11/1932 | Norway | 209/672 |

*Primary Examiner*—Donald T. Hajec

*Attorney, Agent, or Firm*—Dirk J. Veneman; Raymond W. Campbell

[57] ABSTRACT

A disc screen with spacers of limited compressibility is disclosed which has an elongated metal shaft member with a plurality of screen discs mounted co-rotatively on the shaft member. The screen discs have central shaft receiving openings through which the shaft extends coaxially. The screen discs are separated and spaced on the metallic shaft member by a plurality of metallic nonresilient and nonmetallic resilient spacers located between and coaxial with adjacent screen discs. The preferred embodiment of this invention has two metallic spacers with one nonmetallic resilient spacer between them, with the group of three spacers being located between each pair of screen discs which are spaced along the shaft member. The nonmetallic resilient spacers, which are preferably polyurethane, function to allow limited tilting of the screen discs out of the plane perpendicular to the axis of rotation.

3 Claims, 5 Drawing Sheets

10 Figs

DISC SCREEN WITH CONTROLLED INTERFACIAL OPENINGS

FIELD OF THE INVENTION

The present invention relates to disc screens in general and to disc screens having flexible spacers in particular.

BACKGROUND OF THE INVENTION

Disc screens are utilized for screening or classifying discrete materials such as wood chips, municipal waste, and the like. Disc screens are commonly used in the paper industry to separate wood chips on the basis of thickness prior to pulping. Disc screens have a screen bed with a series of corotating, spaced, parallel shafts, each of which has a longitudinal series of concentric screen discs which are spaced from one another on the shafts. The screen discs of one shaft may interdigitate with the discs of the adjacent shafts. Spaces between the adjacent discs, defined as Interdisc Facial Opening (IFO) permit only material of a prescribed size or smaller to pass downward through the bed of rotating discs. Since the discs are all driven to rotate in a common direction from the in-feed end of the screen bed to the out-feed or discharge end of the bed, particles of material which are larger than the prescribed size will be advanced on the bed to the out-feed end of the bed. In some uses of disc screens, smaller than desirable size material is removed from the material flow, while in other uses larger than desirable material is removed from the flow.

Disc screens in which the screen discs are rigidly attached to a central shaft by methods such as welding are susceptible to damage when, in the course of normal usage, foreign objects such as slightly large chips, rocks, tramp metal or other objects enter the screen and lodge between the discs, becoming trapped. If the screen discs are not free to flex so that the oversize chips or other foreign material may be dislodged, breakage or permanent distortion of the screen disc is likely to result.

Disc screens have been constructed with resilient plastic spacers between the screen discs to permit a degree of flexing of the discs. Disc screens incorporating resilient spacers are disclosed in U.S. Pat. Nos. 4,653,648; 4,741,444; 4,972,959 and 4,972,960. The resilient spacers allow the discs to tilt out of the plane perpendicular to their rotation about the central shaft, thereby allowing the foreign object to be dislodged from the screen without damaging or permanently deforming it.

Polyurethane has been employed as a resilient spacer material, and possesses many advantageous physical properties for such use. However, long term "set", which is a permanent change in dimension caused by load, can result in IFO changes over time. These changes in dimension are proportional to the amount of material originally present.

To secure best performance of the disc screen, resilient spacers should be selected of consistent resilience to ensure the uniform deflection of the discs on the central shaft. Variations in flexibility may be present in spacers of identical dimensions due to inherent process limitations in the manufacture of the resilient plastic material, which results in the materials having varying resiliency. Slight variations in resiliency of different spacers are increasingly noticeable as the spacing between discs and, therefore, the thickness of the spacer increases.

Furthermore, discs which are spaced a greater distance apart by resilient spacers must be spaced by spacers of reduced resiliency, if the same maximum deflection is to be maintained. Polyurethanes of reduced resiliency generally suffer greater effects of "set" than do the more resilient polyurethanes.

A disc screen assembly is needed that will be insensitive to commonly encountered resilient material property variations and which will permit easy adjustment of the Interdisc Facial Openings (IFO).

SUMMARY OF THE INVENTION

The disc screen of this invention has an elongated metal shaft member with a plurality of screen discs mounted corotatively on the shaft member. The screen discs have central shaft receiving openings through which the shaft extends coaxially. The screen discs are separated and spaced on the metallic shaft member by a plurality of metallic nonresilient and nonmetallic resilient spacers located between and coaxial with adjacent screen discs. The preferred embodiment of this invention has two metallic spacers with one nonmetallic resilient spacer between them, with the group of three spacers being located between each pair of screen discs spaced along the shaft member. Several alternate embodiments are disclosed, which include variations in the arrangements of metallic and nonmetallic spacers.

The nonmetallic resilient spacers function to allow limited tilting of the screen discs out of the plane perpendicular to the axis of rotation, and are preferably polyurethane with 90 A durometer.

It is an object of the present invention to provide a screen disc arrangement wherein the discs are elastically supported and wherein the elasticity of support and the spacing of the discs are independently adjustable so as to better control the amount the discs may deflect out of their radial planes on a temporary basis to accommodate lumpy foreign elements and automatically return to their radial planes after the foreign elements have been discharged.

It is another object of the invention to provide disc screen spacers which achieve controlled resiliency despite manufacturing variations in the resilient material employed.

A further object of the present invention is to provide disc screen spacers which permit the use of similar resilient spacer material for disc screen shaft assemblies of various disc spacings while maintaining consistent deflectability of the discs on the shafts.

A still further object of the present invention is to provide disc screen spacers which minimize the effects of long term set of the resilient spacer material, thereby maintaining long-term consistency in IFO spacings of the discs in a disc screen.

Other objects, features, and advantages of the invention will be apparent from the following detailed description when taken in conjunction with the accompanying drawings.

DESCRIPTION OF THE PREFERRED EMBODIMENT

Figure 1:
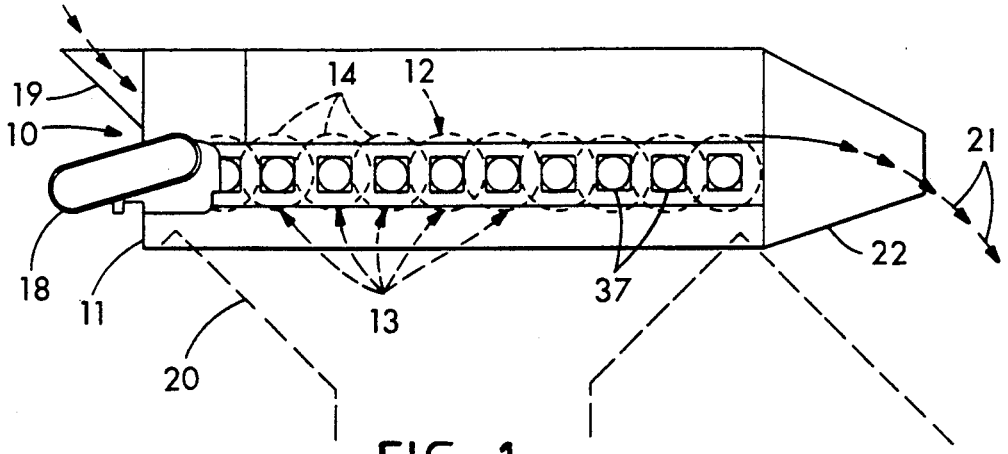
FIG. 1 is a side-elevational schematic view of a disc screen apparatus of the invention.

Referring now to FIGS. 1-10 wherein like numbers refer to similar parts, FIG. 1 shows a disc screen apparatus 10 having a frame 11 supporting a screen bed 12 which has a series of co-rotating, spaced, parallel shaft assemblies 13 of generally cylindrical perimeter and similar length, and each of which has a longitudinally disposed series of concentric metal screen discs 14. The screen discs 14 of each of the shaft assemblies 13 are shown interdigitating with the discs of the adjacent shafts. However, the disc screen spacers of this invention are also applicable to screen discs where the screen discs 14 are not interdigitated but operate with the screen discs 14 tip to tip. Each of the shaft assemblies 13 is rotatably mounted on the frame 11. Unison driving of the shaft assemblies 13 in the same direction, clockwise as seen in FIG. 1, is adapted to be effected by suitable drive means 18.

Figure 4:
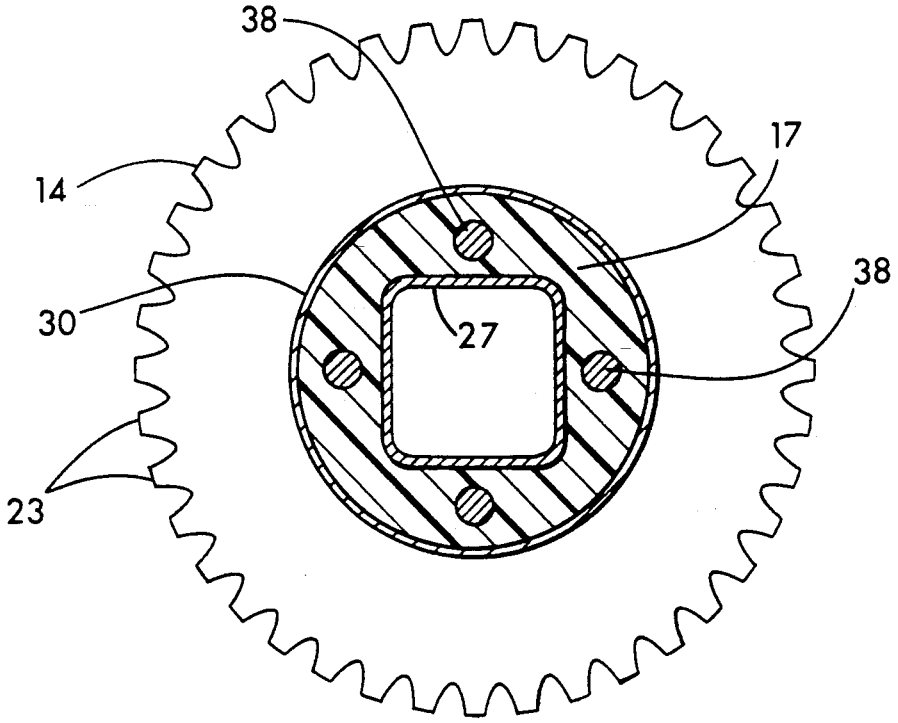
FIG. 4 is a cross-sectional view of the disc screen module of FIG. 2, taken along the section line 4—4.

Discrete material to be screened is delivered to the infeed end of the screening bed 12 by means of an infeed chute 19. On the screening bed, particles less than the predetermined size drop through screening slots defined by the spaces between the discs 14, and are received in a hopper 20. Particles which are too large to pass through the screening slots are advanced to and discharged, as indicated by the directional arrows 21, from the discharge end of the screening bed, by means of an outfeed chute 22. The screening function of the discs 14 may be enhanced by a uniform, generally sawtooth configuration provided by teeth 23 at the outer perimeter of the screen discs 14, as best seen in FIG. 4. The number of such teeth and their size may be dictated by the particular material to be processed. Although shown as having a relatively sharp, sawtooth shape, the teeth 23, depending upon use, may be of different geometric forms, such as lobulate or the like.

Figure 2:
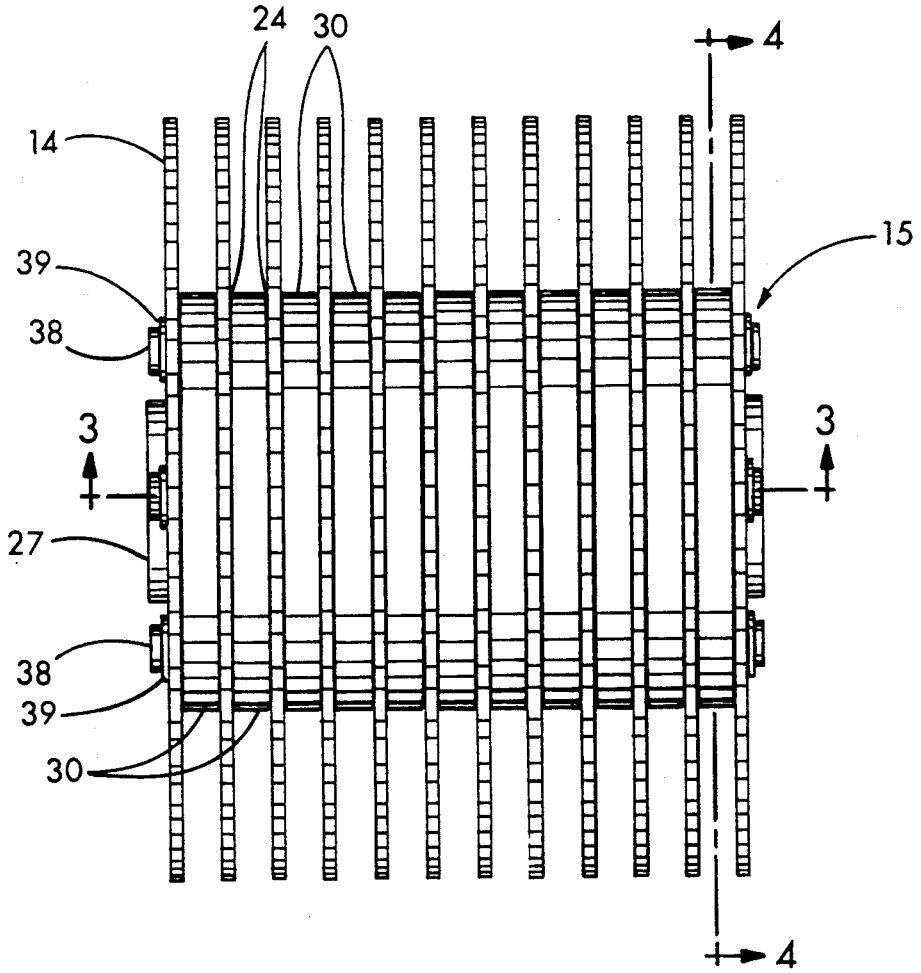
FIG. 2 is an elevational view of one embodiment of a disc screen module of the apparatus of FIG. 1.
Figure 3:
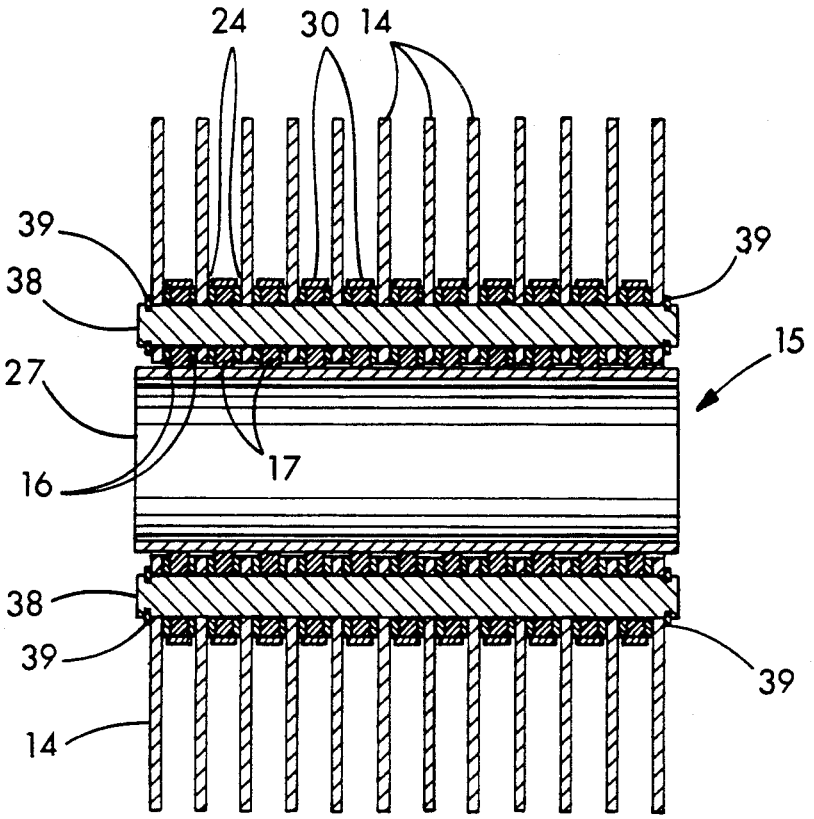
FIG. 3 is a cross-sectional view of the disc screen module of FIG. 2, taken along the section line 3—3.

A preferred embodiment of the disc screen module is illustrated in FIGS. 2-4. A plurality of screen discs 14 are mounted in a module assembly 15, in axial spaced relation to provide axial spaces therebetween. The screen discs 14 each extend outwardly from a shaft 27 in a relatively true radial plane. As best shown in FIG. 3, the module assembly 15 has nonresilient metallic spacers 16 which lie adjacent to and alongside the screen discs 14. A resilient nonmetallic spacer 17 is located between the metallic spacers 16. As best shown in FIG. 4, the metallic and nonmetallic spacers are circular in perimeter and are adapted to be co-axially mounted on the shaft 27. Three spacers are thus located between each pair of screen discs 14, a resilient spacer 17 to permit flexing of the screen discs, and a nonresilient spacer 16 on each side of the resilient spacer 17, selected to achieve the desired axial separation between the screen discs 14.

The nonresilient metallic spacers 16 preferably are formed of castable, relatively soft metal such as zinc or aluminum. The relatively soft metal of the metallic spacers minimizes galling or other deterioration of the discs as contacted by the spacers. The nonresilient spacers 16 are formed to provide a significant portion of the spacing dimension between the screened discs, thereby minimizing the amount of resilient spacer material 17 required.

The resilient spacers 17 preferably are formed of resilient plastic material, such as polyurethane of 90 A durometer, which is selected to achieve the maximum desired amount of flex in the disc screens under expected loads. In an advantageous assembly process, the material of the resilient spacer 17 is injection molded between the metallic spacers 16 and bonded thereto, to provide an integral assembly of the resilient spacer sandwiched between two metallic spacers.

To fabricate disc screen modules 15 to accommodate particles of different dimensions, the nonresilient spacers may be produced of greater or lesser axial width. With this three-part spacing, greater spacing between discs 14 may be achieved without increasing the amount of resilient spacing material used. As it is common to encounter significant variation in flexible properties in flexible resilient material, the minimization of the amount of flexible material utilized results in a significant reduction in the variability of performance between disc screen modules fabricated from different lots of flexible material. A lesser amount of material of greater resiliency may be used than if the entire spacer is resilient, which greater resiliency material experiences less deformation from set than lesser resilient materials.

Under conditions where exposed plastic is undesirable, the resilient spacers 17 may be shielded by metal surrounds 30. The surrounds 30 are portions of a cylinder which surround the resilient spacer material and act to protect the plastic material of the spacer while retaining a small gap 24 between the surround and the screen discs 14 to permit the spacers 17 to flex so that foreign material does not become lodged between the screen discs 14. The surrounds 30 overlie the metal spacers 16 and the resilient spacers 17, and are of an axial length slightly less than the axial length of the interdisc facial openings, to allow the resilient spacer 17 to be compressed, and thus permit limited flexure of the discs.

The screen disc module 15 is held together in a compressed state by pins 38 and snap rings 39, as best shown in FIG. 3. The pins 38 pass through holes in the spacers 16, 17 and screen discs 14. The disc module 15 has a non-cylindrical shaft member 27 on which the discs 14, resilient spacers 17, and nonresilient spacers 16 are mounted.

The modular assembly 15 is mounted on a screen disc assembly shaft 37 to form a shaft assembly 13 which is mounted in the frame 11. The centrally located shaft 37 provides the drive power which causes the screen discs on the disc modules to rotate and to classify material such as wood chips.

The screen disc assembly 15 which employs resilient screen disc spacers 17 situated between pairs of nonresilient spacers 16 results in a screen disc module 15 which may be readily and accurately assembled without special hand matching of components.

The employment of screen disc spacers disclosed herein simplifies the design and manufacture of disc screens for classifying materials of various sizes. Knowing the size of the material to be classified, the designer will pick the spacing of the screen discs 14 on the screen disc module shaft 27. The designer may then pick a resilient spacer of a standard thickness and material which will impart a given amount of resilient deflection capability to the screen discs 14 making up the screen disk module 15. The designer will then choose nonresilient metal spacers to be placed on either side of the resilient spacers 17 and between the screen discs 14, so spacing the screen discs 14 the required distance apart. By separating the functions of resiliently mounting the discs 14 and spacing the discs 14, the designer is relieved of the requirement of engineering a single material to achieve both objectives and of the problems of consistency and repeatability of the spacing material. The use of standard material of known resiliency for resilient spacers 17 between nonresilient spacers 16 reduces the costs and eases the manufacture of disc screens for classifying materials of various sizes.

The resilient spacers 17 serve not only to allow the screen discs 14 to resiliently deflect out of the radial plane to pass foreign objects or the like, but, in the preferred embodiments, also serve to transmit the drive force from the screen disc module shaft 27 to the screen discs 14. The use of resilient material between the screen discs 14 and between the screen discs and the screen disc module shaft 27 prevents the screen discs 14 from being affixed to the shaft 27 by galling or corrosion. The resilient spacers 17 serve to transmit the drive power from the shaft member 27 and cause the screen discs to rotate and to classify material such as wood chips.

Figure 5:
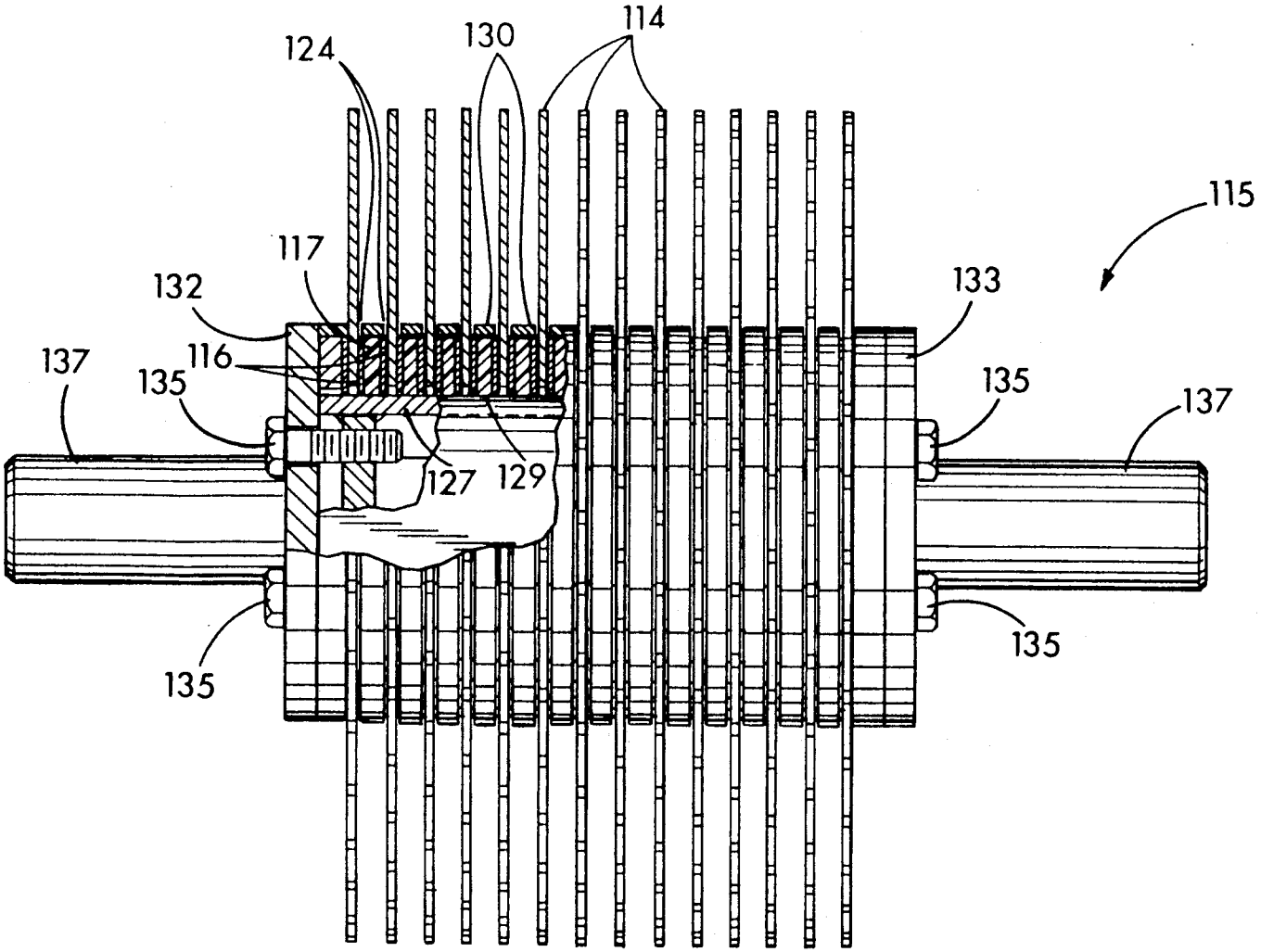
FIG. 5 is an elevational view, partially broken away and in partial cross-section of another embodiment of a disc screen module of the present invention.

An alternative embodiment of the screen disc module 115 of this invention is shown in FIG. 5 and employs resilient spacers 117 and nonresilient spacers 116. The screen discs 114 of the module 115 are assembled together with nonresilient spacers 116 and resilient spacers 117 on a module shaft 127.

The inner edge of the discs 114 are so sized that they do not seat firmly on the shaft 127 but allow a small space between the shaft 127 and the discs 114. The resilient spacers 117 abut the surface 129 of the shaft 127 while the metallic nonresilient spacers 116 and the screen discs 114 are spaced slightly from the surface 129 of the shaft 127. The screen discs 114 and the resilient spacers 117 and nonresilient spacers 116 are held compressed by end plates 132 and 133 which are held by clamping bolts 135. The screen disc module 115 is mounted on modular assembly shaft 137 which is mounted on frame 11 in the screen disc apparatus 10. The disc screen module 115 has surrounds 130 which overlie the resilient plastic spacers 17, protecting them from pitting and exposure to the material being screened. A small gap 124 between each surround 130 and pair of screen discs 114 allows the screen discs 114 to deflect out of the radial plane by compressing the resilient spacers.

The disc screen module 115 achieves the advantages of independent control of screen disc 114 spacing and the amount of resilient deflection by the screen discs 114 out of the radial plane.

Figure 6:
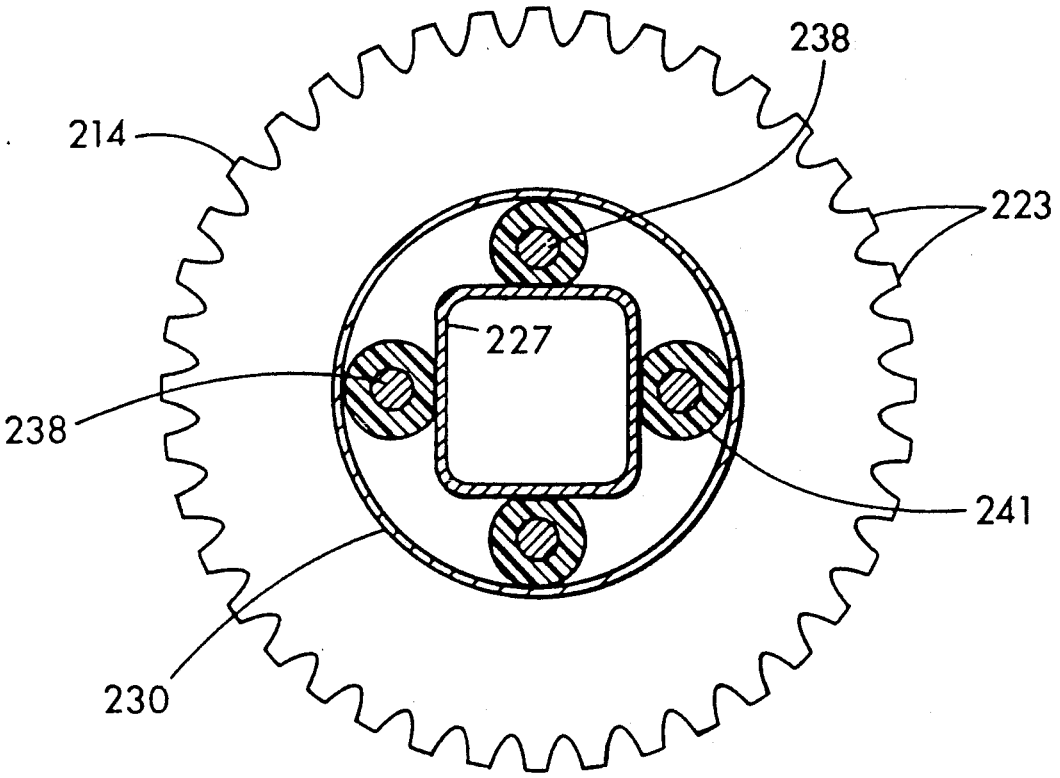
FIG. 6 is a cross-sectional view of a disc screen module of this invention employing annular spacers.

FIG. 6 shows a cross section of another embodiment of the disc screen module of this invention which is similar to the disc screen module 15 in employing pins 238 for axially compressing the discs 214 having teeth 223 and the spacers together, and securing the discs and the spacers into a modular unit which is mounted on a shaft member 227. The alternate embodiment shown in FIG. 6 has between each pair of screen discs 214 a resilient spacer 241 and two nonresilient spacers (not shown) in the form of truncated washers mounted about the pins 238. A nonresilient spacer is located on each side of the resilient spacer 241 and has a similar shape. The resilient spacers 241 in FIG. 6 may be protected by a surround 230.

Figure 7:
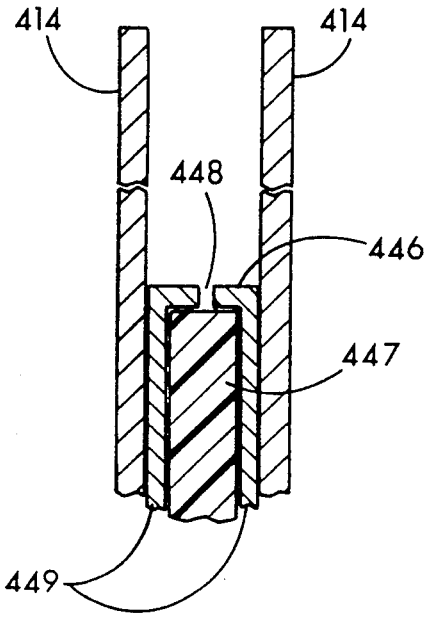
FIG. 7 is a partial cross-sectional view of a disc screen module showing nonresilient spacers on either side of a resilient spacer, the nonresilient spacers having flanges that form a protective surround.

A further embodiment, shown in FIG. 7, has nonresilient metal spacers 449, which lie adjacent to screen discs 414 and on either side of a resilient spacer 447. Each nonresilient spacer has flanges 446 which form surrounds for protecting the resilient spacers 447. The surrounds formed by the flanges 446 will preferably have a small gap 448 between them to allow for the resilient deflection of the screen discs 414 out of the radial plane.

Figure 8:
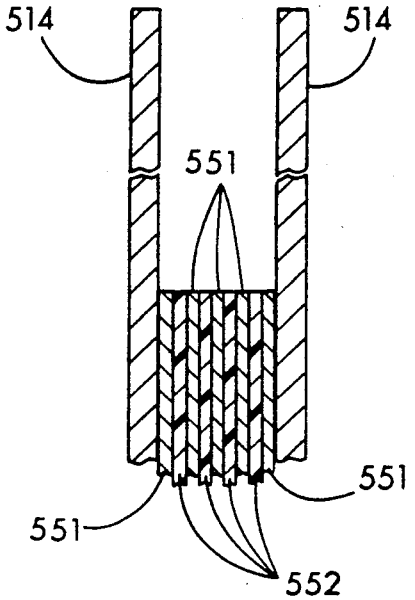
FIG. 8 is a partial cross-sectional view of a disc screen with resilient spacers which is composed of a multiplicity of resilient and nonresilient spacers.

Yet another embodiment of disc screen spacers which allows independent control of disc screen spacing and the amount of resilient deflection of the disc screens is shown in FIG. 8. Mounted between screen discs 514 are a multiplicity of nonresilient spacers 551 and resilient spacers 552. By varying the number and relative thicknesses of the resilient spacers 552 and nonresilient spacers 551, a composite disc screen spacer may be fabricated. The resilient spacers 552 and nonresilient spacers 551 could be bonded together to form a material employing the advantages of this invention.

Figure 9:
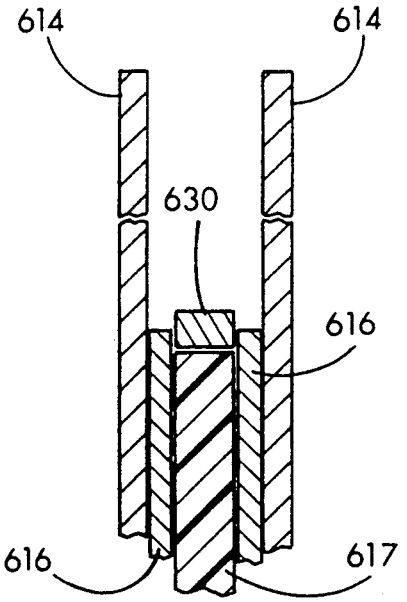
FIG. 9 is a partial cross-sectional view of a disc screen with a metallic surround encircling the resilient spacer.

Although the surrounds 30, 130, 230 are shown overlying the resilient and nonresilient screen disc spacers, the surround 630 as shown in FIG. 9, may overlie the resilient spacers 617 and lie between the nonresilient spacers 616. Small gaps between the surrounds 630 and the nonresilient spacers 616 will allow for the deflection of the screen disc 614 out of the radial plane.

Figure 10:
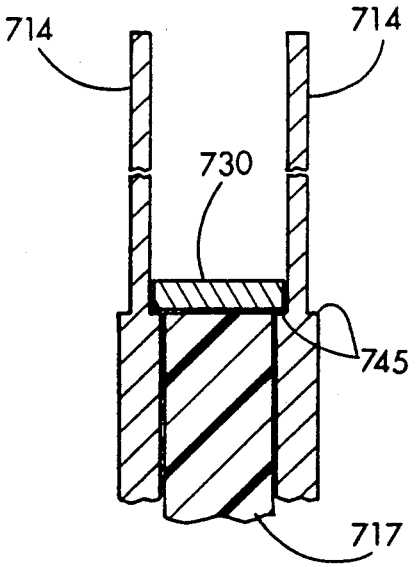
FIG. 10 is a partial cross-sectional view of a disc screen wherein nonresilient spacers are formed from portions of the screen discs.

Although the nonresilient screen disc spacers have heretofore been described as separate from the screen discs, they may, as shown in FIG. 10, be formed from integral portions 745 of the screen discs 714. The integral disc portions 745 serve to reduce the width of the resilient spacer 717, so achieving the advantage of independent control of the screen disc spacing and the amount of resilient deflection of the screen discs. Screen disc spacers 745 and 717 may be overlain by a protective surround 730.

It should be noted that the screen disc modules may be constructed of any desired length, and that the screen discs and the surround discs may be of any desired diameter to appropriately screen out material of determined size.

While the present invention has been shown on what is commonly known as a flat screen, those skilled in the art will recognize that it can be used on other types of disc screens, such as V-screens or split-flow screens and the like.

Also, the present invention may be used on disc screens which interdigitate and also those which run tip to tip.

It is understood that the invention is not confined to the particular construction and arrangement of parts herein illustrated and described but embraces such modified forms thereof as come within the scope of the following claims.

I claim:

1. A disc screen rotatable shaft assembly comprising:

(a) an elongated metal shaft member;

(b) a plurality of screen-discs mounted corotatively on the shaft member and each disc having a central shaft receiving opening for mounting the disc in spaced relations axially to other discs along the shaft member, and each disc of said plurality of screen discs having portions defining at least three openings located peripheral to and spaced around the central shaft receiving opening of the disc;

(c) three or more pins axially extending through the screen discs;

(d) metallic spacer rings located between each pair of screen discs and mounted on the pins, with at least two metallic spacer rings located between each pair of screen discs, on each pin;

(e) a resilient nonmetallic spacer ring between the metallic spacer rings and coaxial with the axially extending pins wherein the pins compressively connect the discs and the resilient and nonresilient spacer rings together into modular units supported on the shaft member to affect limited resilient tilting of the discs relative to the axis of the shaft.

2. The disc screen of claim 1 further comprising:

(a) an annular metallic surround encircling the resilient spacer between adjacent screen discs, the surround having an axial dimension slightly less than the axial spacing between the screen discs so that deflection of the discs out of their radial planes will compress the nonmetallic resilient spacer but not the surround.

3. The disc screen rotatable shaft assembly of claim 1 wherein the two metal spacer rings located adjacent to the sides of the screen discs have portions extending axially over the resilient nonmetallic spacer ring between them so forming a protective metal surround.

* * * * *